US005419723A

United States Patent [19]

Villiers et al.

[11] Patent Number: 5,419,723

[45] Date of Patent: May 30, 1995

[54] FLEXIBLE BLADE FEMALE ELECTRICAL CONTACT

[75] Inventors: Gerard Villiers, Vanves; Yves Dohan, Paris, both of France

[73] Assignee: Framatome Connectors International, Paris, France

[21] Appl. No.: 189,194

[22] Filed: Jan. 31, 1994

[30] Foreign Application Priority Data

Feb. 2, 1993 [FR] France ..... 93 01083

[51] Int. Cl.[6] ..... H01R 13/00

[52] U.S. Cl. ..... 439/843; 439/246

[58] Field of Search ..... 439/843, 852, 246

[56] References Cited

U.S. PATENT DOCUMENTS 4,447,110 5/1984 Punako et al. ..... 439/843

5,302,145 4/1994 Spinnato et al. ..... 439/843

FOREIGN PATENT DOCUMENTS 0105766 4/1984 European Pat. Off. .

1540601 4/1970 Germany .

*Primary Examiner*—Eugene F. Desmond

*Attorney, Agent, or Firm*—Perman & Green

[57] ABSTRACT

A female electrical contact comprises at least one flexible blade extending in a longitudinal direction and elastically deformable transversely to this longitudinal direction. It includes a contact member comprising the flexible blade or blades, a rear portion attached to the flexible blade or blades and an electrically conductive contact support. The rear part of the contact member and the contact support have complementary holding members which cooperate mechanically so that rotation of the contact member in at least one direction about its rear portion offsets its longitudinal axis relative to a nominal direction without significantly deforming the flexible blade or blades.

12 Claims, 1 Drawing Sheet

FLEXIBLE BLADE FEMALE ELECTRICAL CONTACT

BACKGROUND OF THE INVENTION

1. Field of the Invention

The present invention concerns a female electrical contact of the type including at least one flexible blade extending in a longitudinal direction and elastically deformable transversely to said longitudinal direction.

2. Description of the Prior Art

Electrical contacts of this kind are known for making contact with low insertion forces. They usually have two flexible blades and the electrical contact is made in a single piece, the rear part of the electrical contact being fitted to a wire. These electrical contacts are designed to be incorporated into openings in insulative central bodies of connectors to form connectors with a large number of contacts.

The need for a large number of contacts leads to the need to reduce the size of the contacts, which makes it particularly difficult to reconcile the various technical constraints applicable to such contacts.

Accurate coaxial alignment of the male contact and the female contact is particularly difficult to achieve, which leads in practise to a significant increase in the insertion force. Misalignment of the male contact and the female contact can also lead to premature contact wear.

An object of the present invention is a female electrical contact with which at least the above mentioned problem can be avoided, and which in particular means that less strict coaxial alignment between the male contact and the female contact can be tolerated without any significant increase in the insertion force.

SUMMARY OF THE INVENTION

The invention consists in a female electrical contact comprising at least one flexible blade extending in a longitudinal direction and elastically deformable transversely to said longitudinal direction, a contact member comprising the flexible blade or blades, a rear portion attached to the flexible blade or blades and an electrically conductive contact support, wherein the rear parts of the contact member and the contact support have holding members with complementary surfaces which cooperate mechanically so that rotation of the contact member in at least one direction about its rear portion offsets its longitudinal axis relative to a nominal direction, preferably without significant elastic deformation of the flexible blade or blades. When a complementary male contact is inserted the coaxial alignment can therefore be reestablished by reorientation of the female electrical contact, without increasing the insertion force. The electrical contact can include a cut and rolled contact member advantageously made from an undeformable elastic material, the contact support being in the form of a tube.

The contact member advantageously includes two opposed flexible blades.

The complementary holding members may include a female profile and a male profile cooperating mechanically to enable rotation of the contact member in all directions about its rear part to offset its longitudinal axis relative to the nominal direction without significant elastic deformation of the flexible blade or blades.

In a preferred embodiment of the invention the female profile is a groove on the contact support and the male profile is an internal annular profile of the rear portion of the contact member. The internal annular profile advantageously has a rounded cross-section, producing a ball-and-socket joint operative in all directions. In particular, the rounded cross-section can have a width substantially equal to that of the groove so that the rounded cross-section is in contact with the groove only in the vicinity of a central region thereof.

The internal annular profile is advantageously mounted in the groove with a small nominal clamping force. The contact support advantageously has at least one region whose external contour is adapted to limit said offsetting of the longitudinal axis of the contact member, for example a cylindrical portion forward of the groove and having a given clearance relative to a respective first cylindrical region of the rear portion and/or a cylindrical portion to the rear of the groove and having a given clearance relative to a respective second cylindrical region of the rear portion.

The electrical contact can comprise a tube fixed rigidly into the contact support and surrounding the contact member, to restrict the angle of said rotation.

The contact member can then have a region on the upstream side of the root of the flexible blades, in the vicinity of said base, said region having a given nominal clearance relative to the tube.

Other features and advantages of the invention emerge more clearly from the following description given by way of non-limiting example with reference to the drawings.

FIG. 1*a* is a view of a contact support in accordance with the invention in partial longitudinal cross-section.

FIGS. 1*b* and 1*c* are respectively views of a contact member in accordance with the invention in longitudinal cross-section and in lefthand side elevation.

FIG. 2 chows the contact member from FIG. 1*b* at an intermediate stage of manufacture.

FIG. 3 shows an assembled female electrical contact in accordance with the invention.

DETAILED DESCRIPTION OF THE PREFERRED EMBODIMENT

Figures 1A, 1B, 1C, 2, 3:
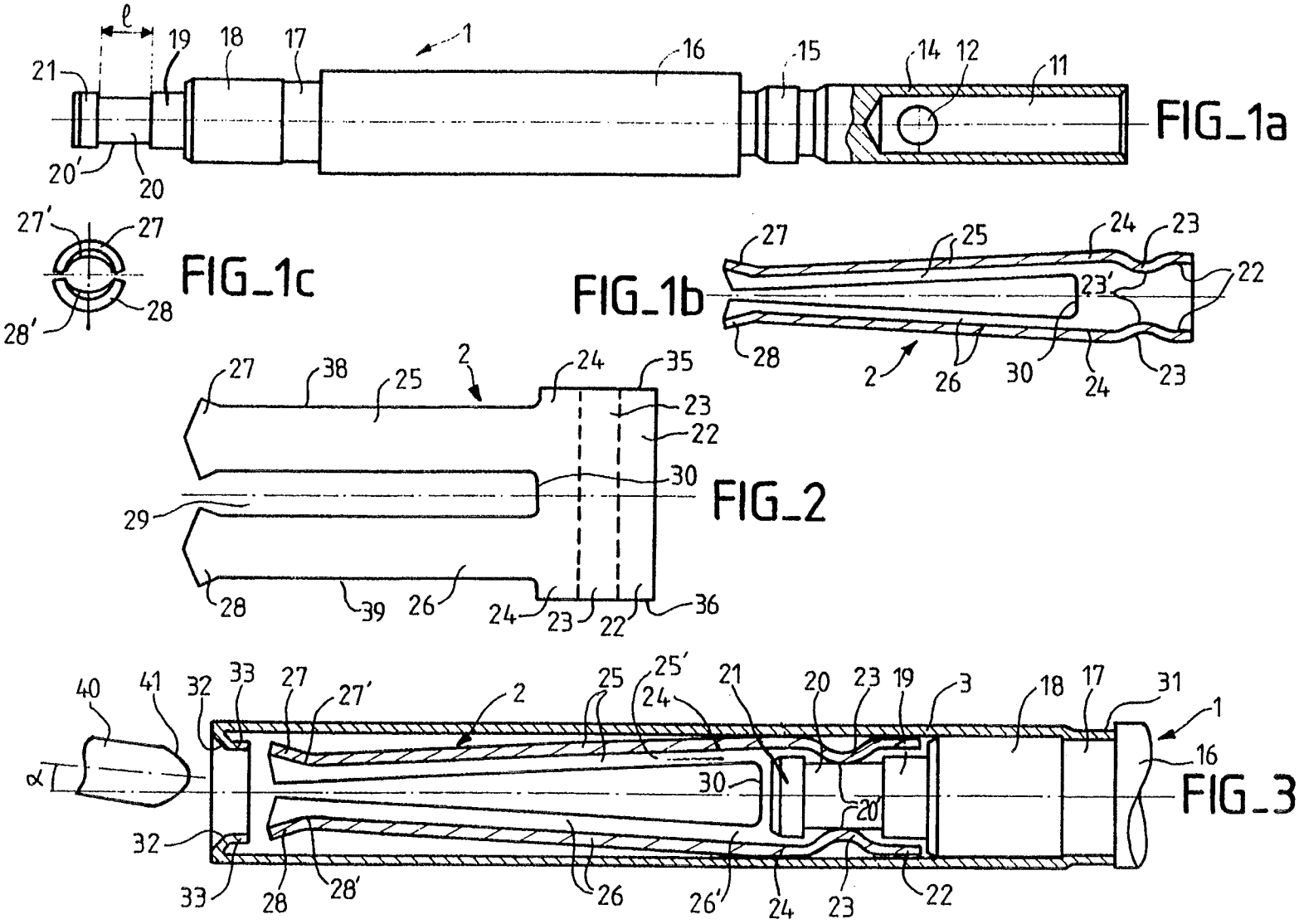

FIG. 1*a* shows a contact support 1 which has a cylindrical rear part 14, an opening 11 adapted to receive a connecting wire and an inspection hole 12. The contact support 1 has a larger diameter cylindrical central part 16 which is extended forwardly by a smaller diameter part 17 adapted to receive a tube 3, a wider part 18 and a front end part 19, 20, 21 including two cylindrical parts 19 and 21 of substantially the same diameter in which is a groove 20 of width L.

The contact member 2 shown in FIGS. 1*b* and 1*c* has a rear part 22, 23, 24 comprising two cylindrical parts 22 and 24 joined together by an inwardly curved annular profile 23 the inside surface of which is rounded in a flattened OMEGA shape. The cylindrical part 24 extends roughly to the root 30 of flexible spring blades 25 and 26 which curve towards the longitudinal axis of the contact member 2 as far as a minimal diameter part 27', 28' extended by flared tips 27 and 28.

FIG. 2 shows that the contact member 2 is easily made from a precut flat blank by first cutting and then rolling the blank utilizing techniques routinely employed in precision mechanical engineering. The member 2 is rolled in such a way as to join the lateral edges 35 and 36 of the rear part 22, 23, 24, the flexible blades 25 and 26 being separated by a groove 29 on the longitudinal axis of the flat member 2 and two contiguous half-grooves 38 and 39 aligned with the lateral edges 35 and 36.

FIG. 3 shows the assembled electrical contact. The smallest cross-section part 23' of the annular profile 23 is in contact with the annular groove 20 near its middle region 20'. The inside edge of the cylindrical region 24 has a diameter greater than that of the region 21, which enables limited relative angular movement of the contact member 2 which can pivot virtually freely because of the ball and socket joint effect of the curved profile 23 within the central region 20' of the groove 20. The point of contact moves during such rotation. The same reasoning applies to the cylindrical part 22 around the cylindrical part 19 of the contact support 1. In other words, relative angular movement of the contact member 2 can be limited to the front of the holding member 23 and/or to its rear.

The female contact member can include a tube 3 which is a rigid shrink fit around the cylindrical part 17 at 31. The inside diameter of the tube 3 fits around the cylindrical part 18, the tube 3 extending forwardly beyond the ends of the flexible blades 25 and 26. The front end of the tube 3 has an entry chamfer 32 extended rearwardly by a cylindrical part 33 whose diameter is substantially equal to that of the end of the interior tips 27 and 28, to facilitate the insertion of a male electrical contact 40.

In the case of a female electrical contact having a tube like the tube 3 relative angular movement can also be limited by sizing the outside diameter of the cylindrical part 24 on the upstream side of the root 30 of the edges 25 and 26 relative to the diameter of the tube 3 in order to produce a given clearance which limits relative angular movement. This argument applies equally to the outside diameter of the cylindrical part 22.

On insertion of a male contact member 40 through the chamfer 32, and assuming that the member 40 has its axis misaligned by an angle $\alpha$ (this is exaggerated in the drawings, but can in practise be in the order of a few degrees), it can be seen that the leading edge 41 of the male member 40 when it enters into mechanical contact with a single tip 27, specifically its smaller section 27', generates a torque which is transmitted by the blade 25 and causes rotation of the contact member 2 about the ball and socket joint 23. The design of the ball and socket joint 23 means that very little force is required to achieve this, which in turn means that elastic flexing of the tip 25 is virtually negligible during such rotation. The rotation continues until opposite and substantially equal torques are applied to the tips 27 and 28 by the contact 40.

To avoid the need for significant forces to cause rotation of the contact member 2, the annular profile 23 is lightly clamped within the groove 20, in order to preserve electrical continuity. For a 0.8 mm diameter groove 20, for example, nominal dimensions which provide a minimum compression of a few hundredths of a millimeter are suitable for the intended application.

With reference to limiting relative angular movement, a tolerance is advantageously adopted enabling a maximum angular relative movement in the order of a few degrees, for example 5°. The width L of the slot 20 can be 0.8 mm, the front part 21 can be 0.4 mm long and the rear part 19 can be 0.5 mm long. The annular profile 23 can have a radius in the order of 0.7 mm. The clearance between the cylindrical parts 19 and 21 and the inside parts of the tube 3 can be in the order of 0.1 mm.

The tube 3 is advantageously made from a material that can be crimped. The contact member 2 is obviously made from a non-deformable elastic material, for example from copper-beryllium alloy 0.15 mm thick, in order to achieve the required function of the flexible blades 25 and 26.

There is claimed:

1. Female electrical contact comprising:

an electrically conductive contact support; and a contact member comprising two opposed flexible blades, each blade extending in a longitudinal direction and being elastically deformable transversely to said longitudinal direction, and a rear portion attached to said flexible blades and connecting said contact member to said electrically conductive contact support, wherein the rear portion of said contact member and said contact support have complementary surfaces which cooperate mechanically so that rotation of said contact member in at least one direction about its rear portion offsets a longitudinal axis of the contact member relative to a nominal direction.

2. Electrical contact according to claim 1 wherein said complementary surfaces are constituted by a female profile and a male profile enabling rotation of said contact member in all directions about its rear part to offset its longitudinal axis relative to said nominal direction without significant elastic deformation of said flexible blade or blades.

3. Electrical contact according to claim 2 wherein said female profile is a groove on said contact support and said male profile is an internal annular profile of said rear portion of said contact member.

4. Electrical contact according to claim 3 wherein said internal annular profile has a rounded cross-section.

5. Electrical contact according to claim 4 wherein said rounded cross-section has a width substantially equal to that of said groove so that said rounded cross-section is in contact with said groove only in the vicinity of a central region thereof.

6. Electrical contact according to claim 3 wherein said internal annular profile is mounted in said groove with a small nominal clamping force.

7. Electrical contact according to claim 1 wherein said contact support has at least one region whose external contour is adapted to limit said offsetting of said longitudinal axis of said contact member.

8. Electrical contact according to claim 7 wherein one such region is a cylindrical portion forward of said groove and having a given clearance relative to a respective first cylindrical region of said rear portion.

9. Electrical contact according to claim 7 wherein one such region is a cylindrical portion to the rear of said groove and having a given clearance relative to a respective second cylindrical region of said rear portion.

10. Electrical contact according to claim 1 comprising a tube fixed rigidly into said contact support and surrounding said contact member.

11. Electrical contact according to claim 10 wherein said contact member has a region on the upstream side of the root of said flexible blades and in the vicinity of said base, said region having a given nominal clearance relative to said tube.

12. Female electrical contact comprising:

an electrically conductive contact support;

a contact member comprising flexible blades, each blade extending in a longitudinal direction and being elastically deformable transversely to said longitudinal direction, and a rear portion attached to said flexible blades connecting said contact member to said electrically conductive contact support, wherein said contact support and the rear portion of said contact member have complementary surfaces which cooperate mechanically so that rotation of said contact member in at least one direction about its rear portion offsets a longitudinal axis of the contact member relative to a nominal direction; and wherein said contact support has at least one region whose external contour is adapted to limit said offsetting of said longitudinal axis of said contact member.

* * * * *